US007414500B2

(12) United States Patent
De Los Santos

(10) Patent No.: US 7,414,500 B2
(45) Date of Patent: Aug. 19, 2008

(54) HIGH-RELIABILITY MICRO-ELECTRO-MECHANICAL SYSTEM (MEMS) SWITCH APPARATUS AND METHOD

(76) Inventor: Hector J. De Los Santos, 18 Arese Aisle, Irvine, CA (US) 92606

( * ) Notice: Subject to any disclaimer, the term of this patent is extended or adjusted under 35 U.S.C. 154(b) by 275 days.

(21) Appl. No.: 11/059,065

(22) Filed: Feb. 16, 2005

(65) Prior Publication Data

US 2005/0178646 A1 Aug. 18, 2005

Related U.S. Application Data

(60) Provisional application No. 60/545,032, filed on Feb. 17, 2004.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,373,349 B2 * 4/2002 Gilbert ..... 333/126
6,674,340 B2 * 1/2004 Quan et al. ..... 333/164
7,265,647 B2 * 9/2007 Qian et al. ..... 333/262
2005/0178646 A1 * 8/2005 De Los Santos ..... 200/181

* cited by examiner

*Primary Examiner*—Elvin Enad
*Assistant Examiner*—Bernard Rojas
(74) *Attorney, Agent, or Firm*—Wilson D Swayze, Jr.

(57) ABSTRACT

A micro-electro-mechanical system (MEMS) slotline switch includes a slotline transmission line structure defined on top of substrate, a doubly-anchored conductive beam disposed perpendicular to, and above slotline so that there is a certain spacing between the beam and the slotline, a second conductive contact attached to the beam directly above the slot of the slotline a bottom conductive contacts defined on bottom surface of substrate and forming parallel-plate capacitor with conductive beam, conductive traces defined on the bottom surface of the substrate forming a microstrip-to-slotline transition for coupling signals in microstrip line to the slotline, and beam and bottom conductive contacts being spaced apart, and the beam being continuously movable when a voltage is applied between the beam and the bottom conductive contacts.

10 Claims, 11 Drawing Sheets

HIGH-RELIABILITY MICRO-ELECTRO-MECHANICAL SYSTEM (MEMS) SWITCH APPARATUS AND METHOD

PRIORITY

The present invention claims priority under 35 USC 119 for the provisional application filed Feb. 17, 2004, Ser. No. 60/545,032

TECHNICAL FIELD

The present invention relates generally to micro-electro-mechanical systems (MEMS) devices and methods. More particularly, the present invention relates to a switch apparatus and method utilizing MEMS technology.

BACKGROUND ART

Micro-electro-mechanical systems (MEMS) devices and methods are presently being developed for a wide variety of applications in view of the size, cost and reliability advantages provided by these devices. Specifically, a MEM switch can be fabricated utilizing MEMS technology. MEM switches known in the prior art are of two types, namely, the series and shunt types. The series type 10, FIG. 1, consists of a beam 16 cantilevered from a switch base, or substrate 24. The beam 16 has an electrode 14 disposed on it, acts as one plate of a parallel-plate capacitor and contains under its tip a contact 20. A voltage, known as an actuation voltage, is applied between the beam 16 and an electrode 22 on the switch base 24. In the switch-closing phase, or ON-state, the actuation voltage exerts an electrostatic force of attraction on the beam 16 large enough to overcome the stiffness of the beam. As a result of the electrostatic force of attraction, the beam 16 deflects and the contact under its tip 20 makes a connection that bridges the gap in a transmission line 18 running under it, closing the switch. Ideally, when the actuation voltage is removed, the beam 16 will return to its natural state, breaking its connection with the signal line 18 and opening the switch.

The shunt type MEM switch 30, FIG. 2, consists of a doubly-anchored beam (bridge) or membrane 32 anchored on a substrate 42 and disposed across a set of ground-signal-ground (GSG) traces 40, 38, 34, respectively, known as a coplanar waveguide (CPW) transmission line. In its normal state, the "pass" or ON-state, the bridge 32 is undeflected and the amplitude of the signal propagating down the CPW line and entering at its input 44, is minimally attenuated by capacitive coupling to the bridge 32 and, through it, to ground 40, 34, after passing exiting at its output 46. An actuation voltage applied between the bridge 32 and an insulation-protected electrode 36 disposed on the CPW's signal conductor underneath it 38, exerts an electrostatic force of attraction on the bridge 32 large enough to overcome the stiffness of the beam. As a result the bridge deflects and substantially increases the capacitive coupling of the signal to the bridge 32 and ground 40, 34. The amplitude of the signal propagating down the signal line 38, which enters at the input 44, after it passes the deflected bridge 32 and exits at the output 46, is now maximally attenuated and the switch may be said to be in its "blocking" or OFF-state. Ideally, when the actuation voltage is removed, the beam 32 will return to its natural state, breaking its connection with the signal line 38.

One problem with these switches is that the deflected-to-undeflected phase, or OFF-state in the series type, and ON-state in the shunt type, is not directly controlled, however, and relies on the forces of nature embodied in the spring constant of the beam to bring the beam to the undeflected state. However, the forces of nature are not always predictable and therefore unreliable.

For instance, in some cases once the actuation voltage is removed, stiction forces, (forces of attraction that cause the beam to stick to the contact electrode), between the beam and the contact electrode overcome the spring restoring forces of the beam. This results in the beam sticking to the contact electrode and keeping the beam down when, in fact, it should be undeflected. Prior art cantilever/bridge type switches have no mechanism to overcome stiction forces upon deflecting down.

Another problem associated with prior art switches is a problem intrinsic to the beam's change of state from undeflected to deflected. The operation of the beam is inherently unstable. When deflecting, the beam deforms gradually and predictably, up to a certain point, as a function of the actuation voltage being applied to the switch. Beyond that point, control is lost and the beam's operation becomes unstable causing the beam to pull-in, i.e., to come crashing down onto the secondary electrode. This causes the beam to stick as described above, or causes premature deterioration of the contact electrode. Both conditions impair the useful life of the switch and result in premature failure.

There is a need for a MEM switch that overcomes the problems associated with prior art cantilevered- and bridge-type switches.

BRIEF DESCRIPTION OF THE DRAWINGS

Exemplary embodiments of the invention will now be explained with reference to the accompanying drawings, of which.

DETAILED DESCRIPTION OF THE INVENTION

Figure 4:
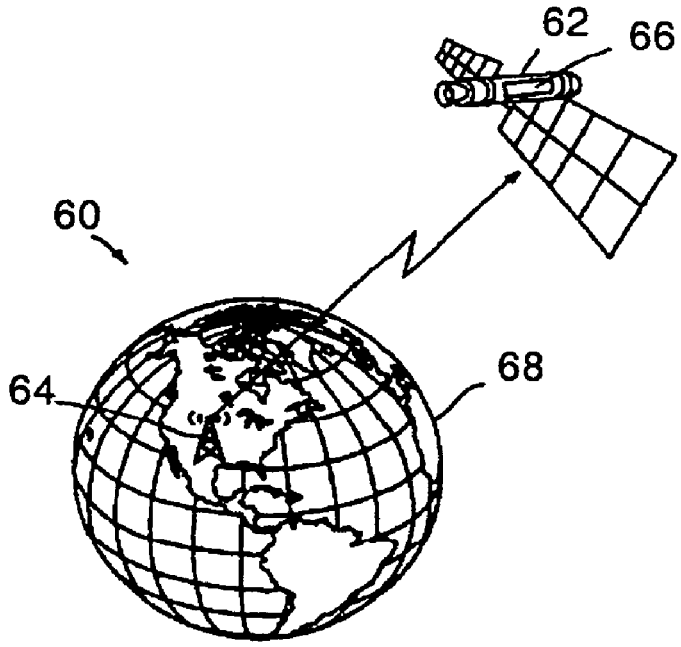
FIG. 4 is a perspective view of a satellite system 60 having microwave circuits 66 that utilize slotline MEM switches in accordance with one embodiment of the present invention.
Figure 5:
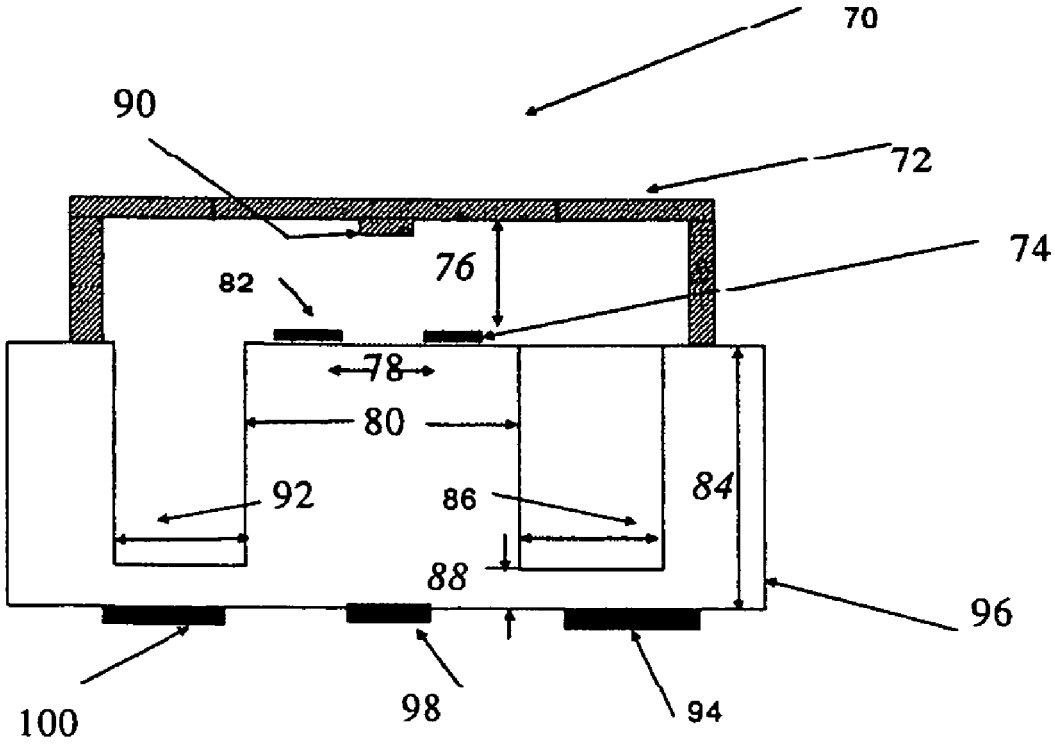
FIG. 5 is an end view of a slotline MEMS switch 70 in accordance with an embodiment of the present invention.
Figure 6:
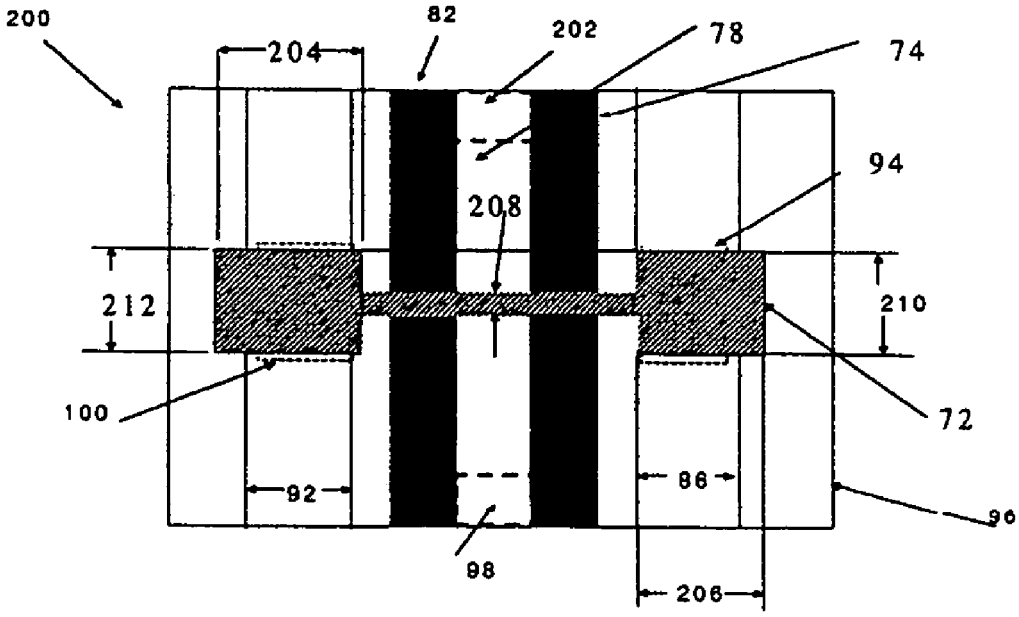
FIG. 6 is a top view of 200 slotline MEMS switch 70 switch in accordance with an embodiment of the present invention.

Referring to FIG. 4, a perspective view of a satellite system 60 in accordance with one embodiment of the present invention is illustrated. The satellite system 60 of comprised of one or more satellites 62 in communication with a ground station 64 located on the Earth 68. Satellite 62 relies upon wireless communication to send and receive electronic data to perform attitude and position calculations and other functions. Without accurate wireless communication, proper satellite function is hindered and at times adversely affected. Each satellite 62 contains one or more switches 66 to effect signal routing.

The conceptual structure of the new MEM switch is shown in FIGS. 5 through 8, and its operation is described as follows: A doubly anchored cantilever beam 72 is disposed across the slot of a slotline 82, 78, 74. The distance $d_0$ (76) from the beam 72 to the slot 78 is chosen such that $d_0<(d_0+h_1-h_2)/3$, where $h_1$ is the substrate thickness 84, and $h_2$ is a minimum substrate thickness 88 so that the beam deflection may be controlled continuously without the occurrence of pull-in [Senturia, S. D., *Microsystem Design* (Kluwer Academic Publishers: Boston, Mass., 2001). Beam 72 width at its center $L_1$ (208) and slot width W (78) set the beam-to-slot parasitic capacitance, which determines insertion loss in the UP state (the thru or passing state) and the shunt capacitance in the DOWN state (the blocking state). $L_2$ (210, 212) and $W_r$ (92) set the electrode area, which partly determines the actuation voltage. $W_b$ (204) adds a degree of freedom to shaping the beam 72. Thus, the beam may be caused to approach the slot to an arbitrarily close distance without it pulling-in/snapping. In the down position, a part of the beam, the "slot-blocking structure" 90, blocks the electric field lines across the slot, thus determining the isolation. Notice that, since in the DOWN state the slot-blocking structure 90 intrudes between the two metal stripes 74, 82 defining the slot 78, it is this action that effects the slot field shielding/blocking and not any contact between the beam 72 and the metal stripes 74, 82. The capacitance between the beam 72 and the slotline stripes 74, 82, whose interpolate gaps are 404 and 406, also contribute to the shunting of the slot and therefore, to the blocking state. In the embodiment of FIGS. 5 through 8, the incoming signal is coupled to the slot via a well-known microstrip-to-slotline transition 98, 202, [S. B. Cohn, "Slot Line on a Dielectric Substrate," *IEEE Trans. Microwave Theory Tech.*, Vol. MTT-17, NO. 10, OCTOBER 1969, pp. 768-778], [M. M. Zinieris, R. Sloan, and L. E. Davis, "A Broadband Microstrip-to-Slot-Line Transition," *Microwave and Optical Tech. Letts.* Vol. 18, No. 5, Aug. 5, 1998, pp. 339, 342.] so there is drop-in compatibility with current systems that employ microstrip lines.

Figure 8:
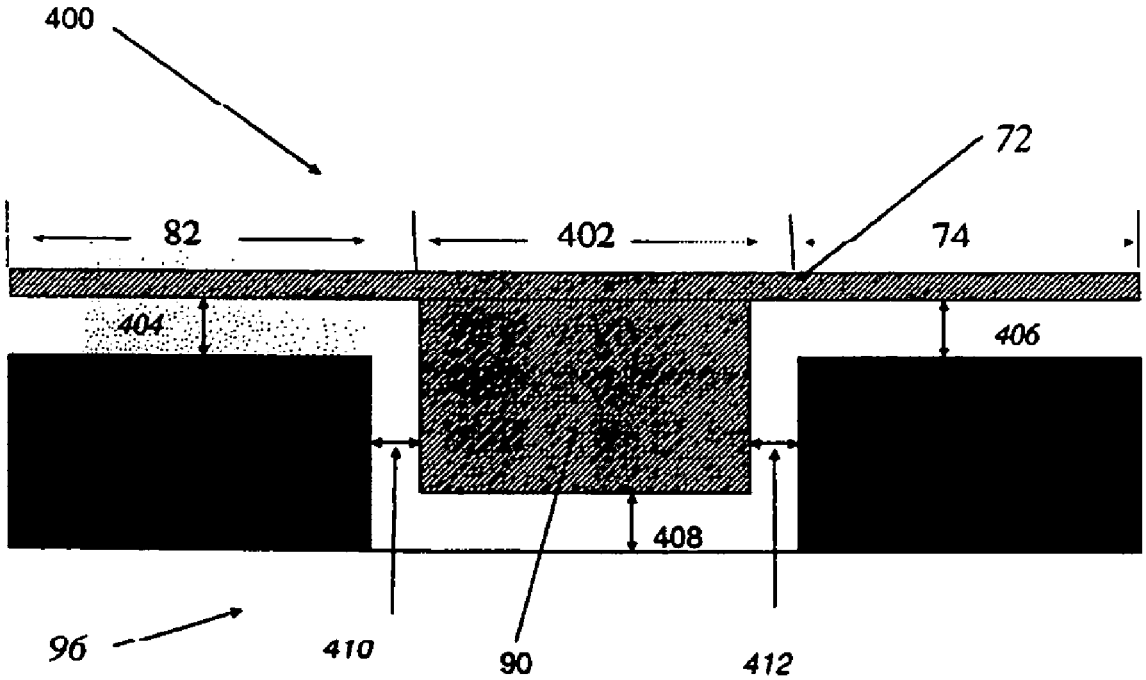
FIG. 8 is a close-up view 400 of the bridge 72 of FIG. 5 in its down position.

The maximum capacitance and, thus, the $C_{DOWN}/C_{UP}$ ratio is determined by the gaps $g_o$, 404, 406 shown in FIG. 8, to which one chooses to position the beam 72 upon controlled actuation, and the gaps 410, 412 of dimension $xW_S$, where $x<<1$, between the metal stripes 74, 82 and the slot-blocking structure 90. For $d_0>>W_S$, (76>>78) $C_{UP}$ corresponds approximately to the characteristic impedance of the slot 78.

Figure 7:
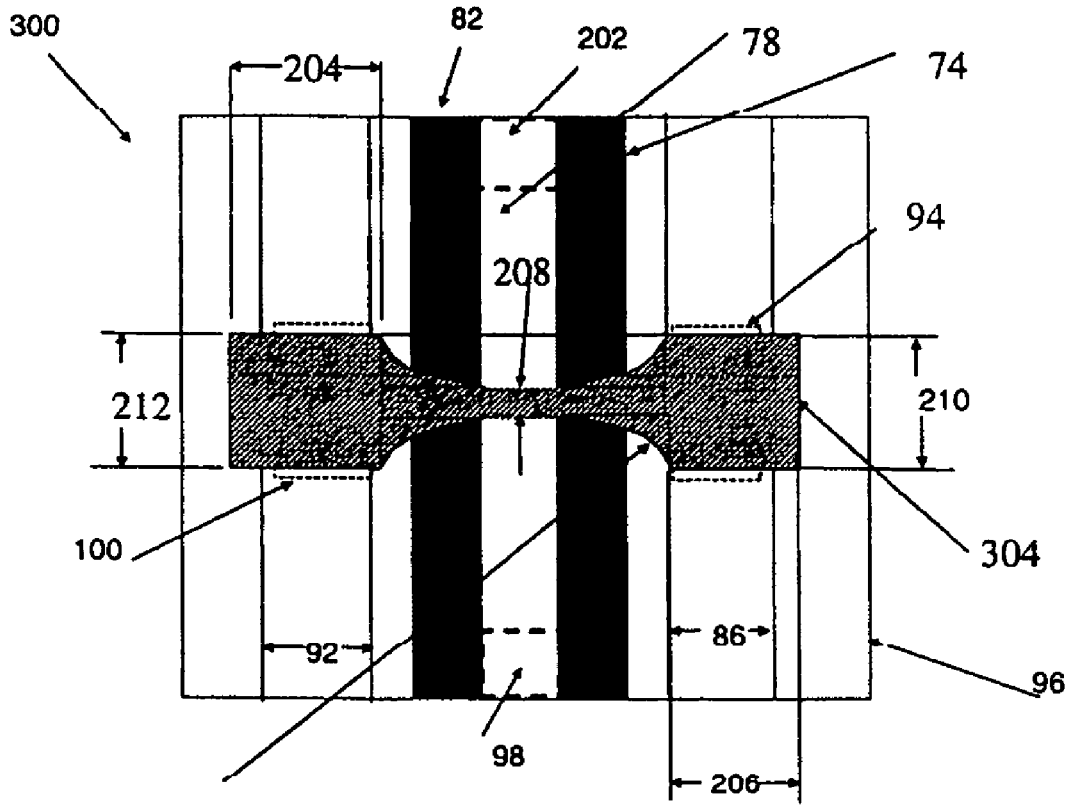
FIG. 7 is a top view 300 of slotline MEMS switch 70 switch with tapered beam 304 in accordance with an embodiment of the present invention.

In another embodiment 300 of this invention, FIG. 7, the beam 304 is tapered to deal with potential stresses during actuation.

Figure 9:
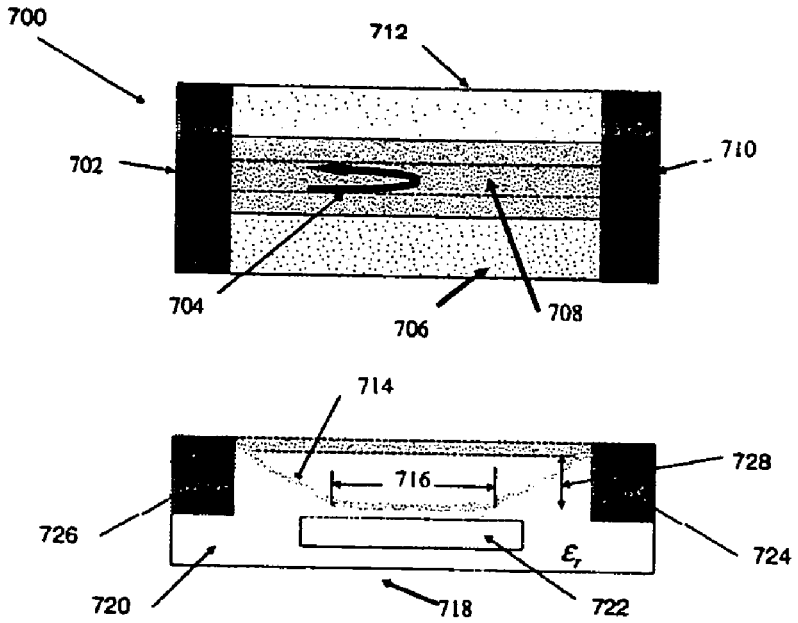
FIG. 9 is top and side views 700 of a second embodiment of this invention.
Figure 10:
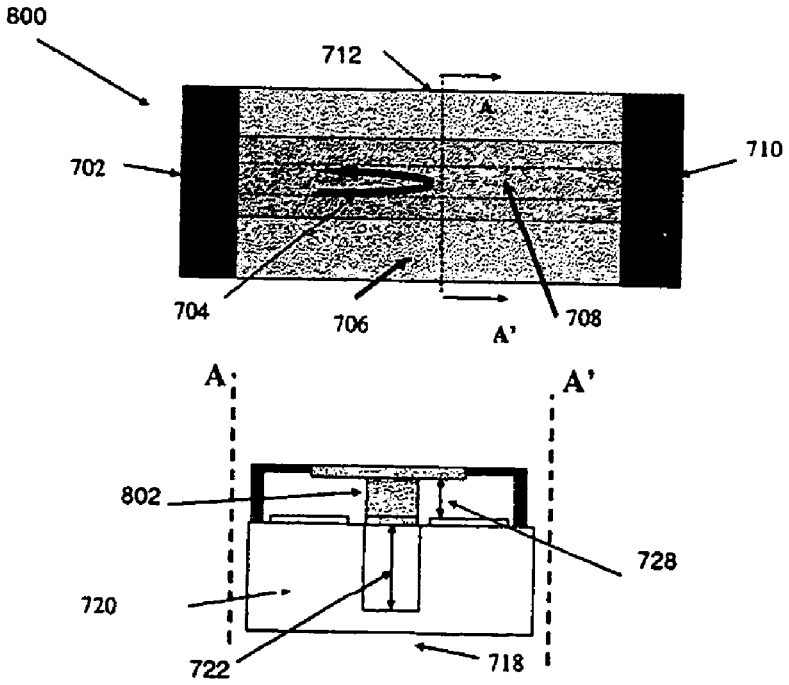
FIG. 10 is top and cross-section views of a blocking contact and beam of this invention.

Yet, in another embodiment 700 of this invention, FIGS. 9 and 10, the beam 714 is disposed longitudinally along the slot 708, and a recess 722 is made under the slot 708. The relationship among the beam-to-substrate distance 728, recess 722 depth, and secondary substrate thickness 730, are chosen such that no pull-in/snapping of the beam is experienced. A blocking contact 802, FIG. 10, shunts the slot upon actuation.

Figure 11:
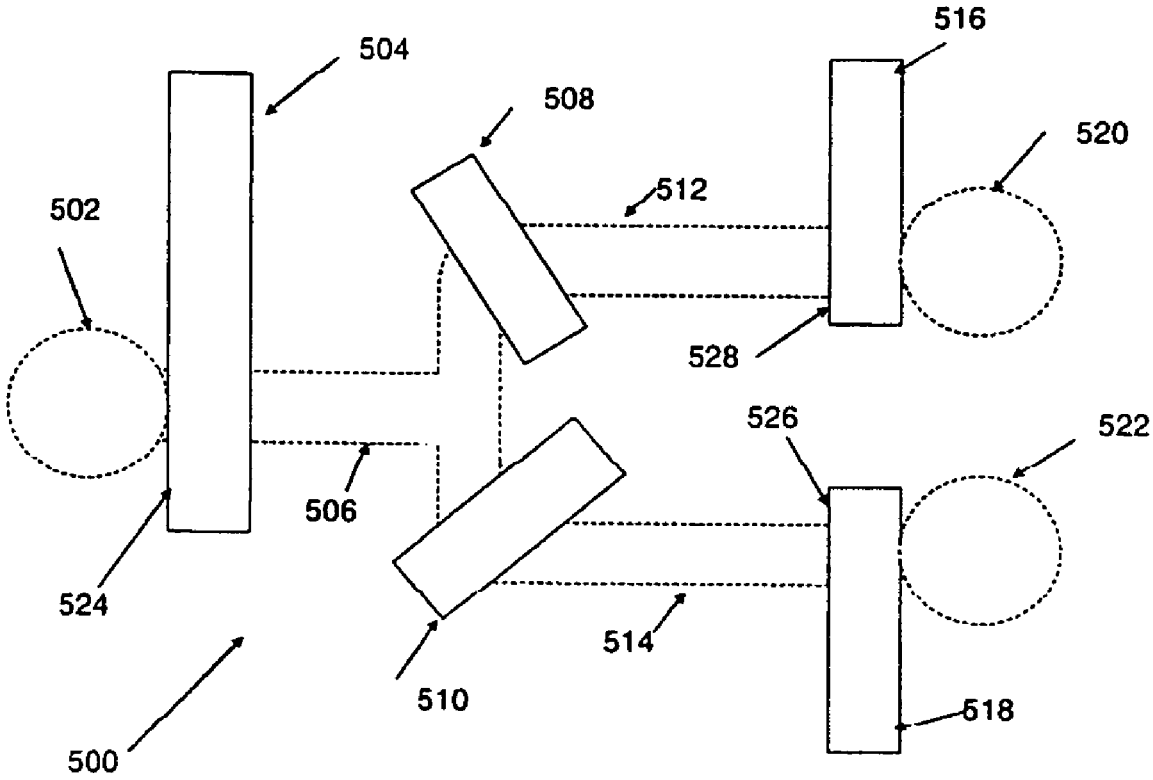
FIG. 11 is a top view 500 of a single-pole double-throw switch using the slotline MEM switches 508, 510 of this invention.

FIG. 11 shows the implementation of a single-pole double-throw switch using the slotline MEM switch of this invention. The incoming signal entering at the microstrip input 504 is coupled to the slotline 506. 502 is a slotline an open circuit stub and 524 is a microstrip open circuit stub whose size is adjusted to optimize the properties of the microstrip-to-slotline transisition. Similar function is played by 520 and 528, and 522 and 520. When the slotline switches 508 and 510 are UP (in the passing state), the input signal divides equally between slotlines 512 and 514, and couples back to the microstrip lines, exiting through terminals 516 and 518, respectively. When switch 508 is DOWN (in the blocking state) and switch 510 is UP (in the passing state), the signal propagating via slotline 506 proceeds to slotline 514 and exits via microstrip terminal 518. When switch 508 is UP and switch 510 is DOWN, the signal propagating via slotline 506 proceeds to slotline 512 and exits via microstrip terminal 516.

Figure 12:
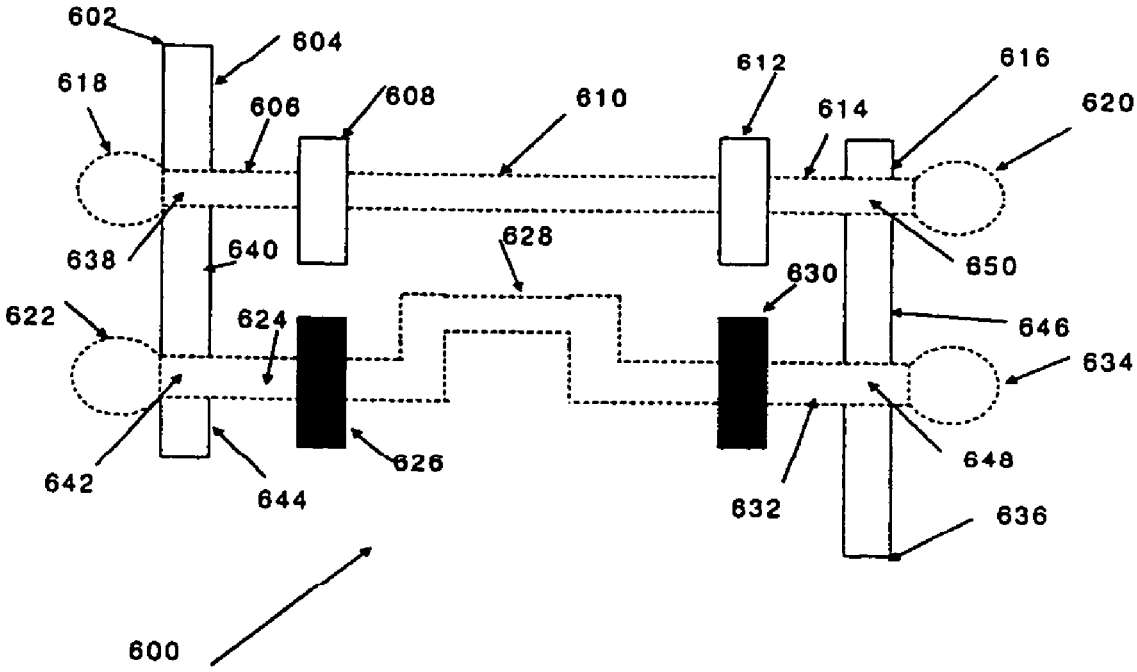
FIG. 12 is a top view 600 of a fundamental switched-line phase shifter bit with propagation via the reference path 606, 610, 614, making use of the slotline MEM switches 608, 612, 626, 632 of this invention.

FIG. 12 shows the implementation of a single-bit phase shifter using the slotline MEM switch of this invention. This is the building block of multi-bit phase shifters. The input signal enters through terminal 602 of microstrip line 604, and exits through terminal 636 with either a minimum reference delay or with a larger delay. The reference delay is experienced through propagation via the shortest path, which consists of the branch containing lines 606, 610, and 614. The larger delay is experienced through propagation via the longer path, which consists of the branch containing lines 624, 628, and 632. Signal steering is effected by blocking its passage through one path or the other. For example, to block the passage through the longer delay path, containing lines 624, 628, and 632, a high impedance must be presented to the signal at the input to this path, namely, at point 642. This is accomplished by choosing the length of line 624 to be one-quarter-wavelength at the frequency of interest, and terminating it with a low impedance. The low impedance termination is effected by setting switch 626 to the DOWN state. Otherwise, to block the passage through the shorter delay path, containing lines 606, 610, and 614, a high impedance must be presented to the signal at the input to this path, namely, at point 638. This is accomplished by choosing the length of line 606 to be one-quarter-wavelength at the frequency of interest, and terminating it with a low impedance. The low impedance termination is effected by setting switch 608 to the DOWN state. To prevent the signal from entering the longer path through the point 648 when it enters through the phase shifter terminal 602 and follows the reference path, 606, 610, 614, 646, 636, a high impedance must be established at this point. Thus, line 632 is also chosen to be one-quarter-wavelength and switch 630 is also set to the DOWN state in this case. On the other hand, to prevent the signal from entering the reference path at the point 650 when it enters the phase shifter bit at terminal 602 and follows the path 640, 624, 628, 632, 636, a high impedance must be established at this point. Thus, line 614 is also chosen to be one-quarter-wavelength and switch 612 is also set to the DOWN state in this case. Elements 618, 620, 622 and 634 are open circuit slot stubs, and elements 616, and 644 are microstrip open circuit stubs, which are chosen to adjust the transmission properties of the microstrip-to-slotline transitions. The length of lines 640 and 646 is chosen to minimize coupling between the two paths, and to facilitate the layout when switch size calls for it.

Figure 1:
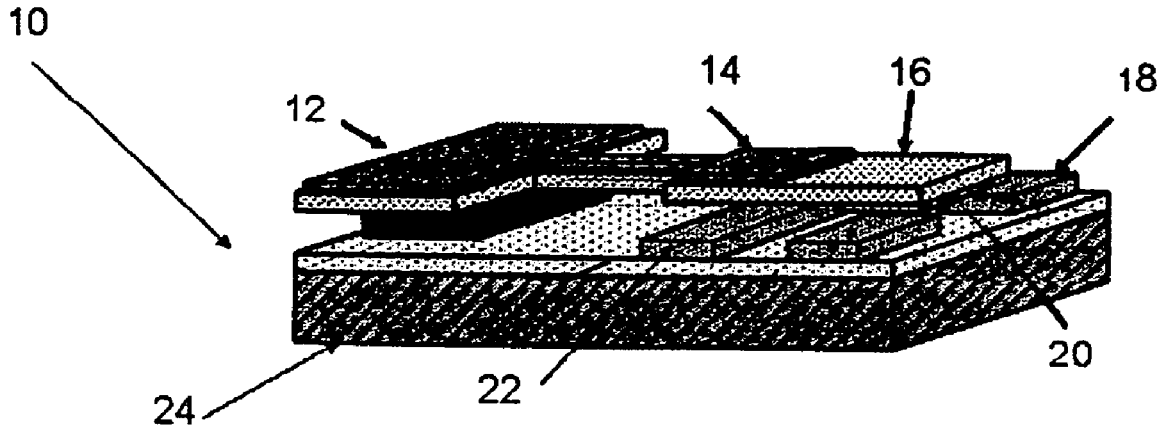
FIG. 1 is a perspective view of a prior art series type MEM switch 10.
Figure 2:
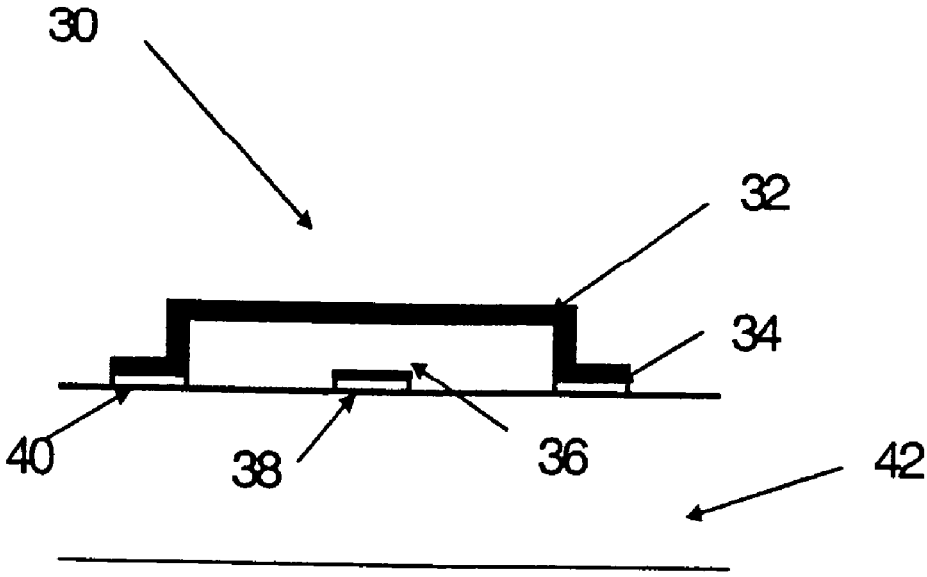
FIG. 2 shows an end view of a prior art shunt type MEM switch 30.
Figure 3:
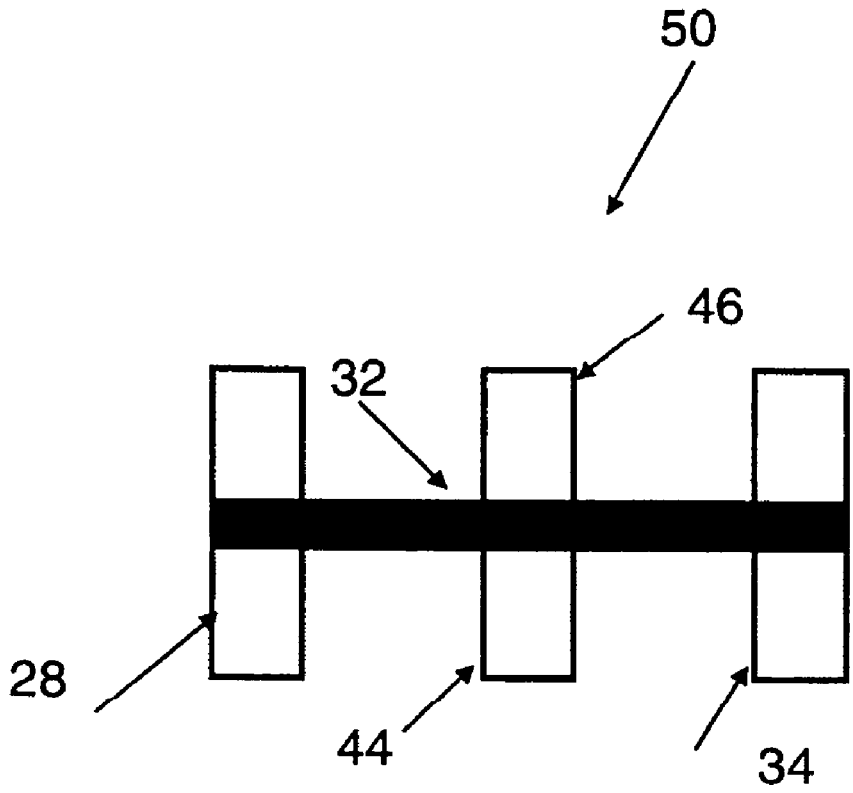
FIG. 3 shows a top view of a prior art shunt type MEM switch 50.
Figure 13:
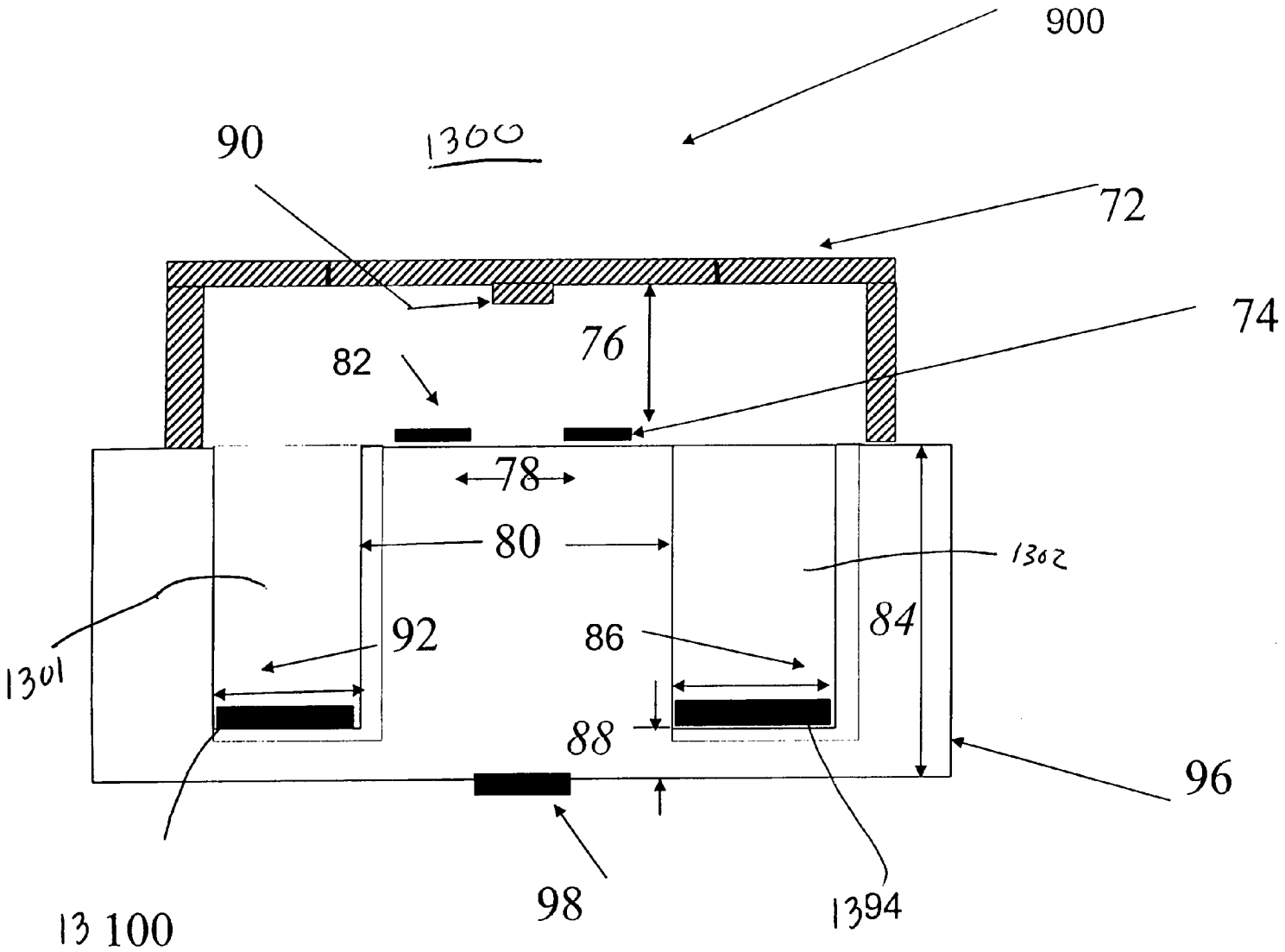
FIG. 13 is a cross-sectional view of another switch of the present invention.

The conceptual structure and the method to form same of additional MEM switches 1300, 1400 is shown in FIGS. 13-22, and its process of fabrication is described. A doubly anchored cantilever beam 72 is disposed across the slot of a slotline 82, 78, 74. The distance $d_0$ (76) from the beam 72 to the slot 78 is chosen as discussed before such that $d_0<(d_0+h_1-h_2)/3$, where $h_1$ is the substrate thickness 84, and $h_2$ is a minimum substrate thickness 88 so that the beam deflection may be controlled continuously without the occurrence of pull-in. In FIG. 13, electrodes 13100 and 1394 are located in recesses 1301 and 1302, respectively. Comparing the switch of FIG. 3 with the switch 1300 of FIG. 13 to show the relative differences, the switch 1300 demonstrates improved control and no snapping as a result of a larger distance $d_0$. The larger distance $d_0$ is a result of a larger distance from the electrodes 13100 and 1394 to the beam 72. Comparing the switch of FIG. 6 with switch 1300 of FIG. 13, the switch 1300 of FIG. 13 requires less voltage to move beam 72 than the switch of FIG. 6, and demonstrates the approximately the same control of beam 72 as the switch of FIG. 6.

Figure 14:
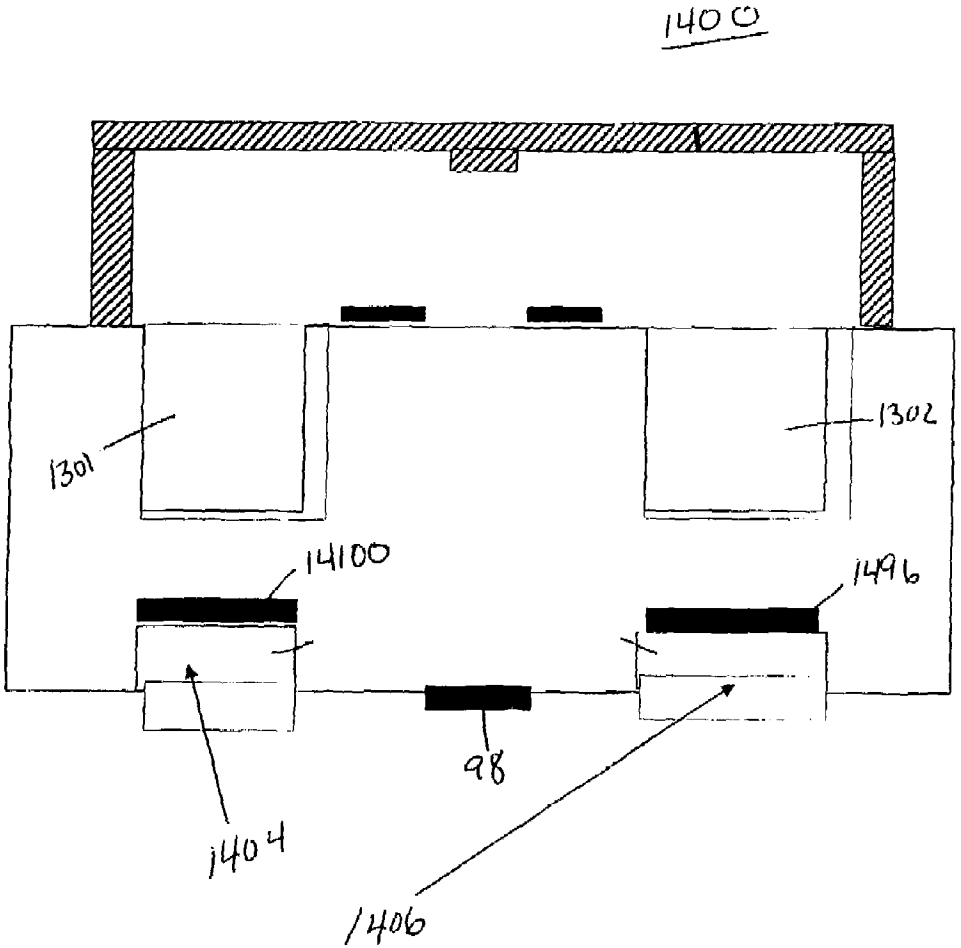
FIG. 14 is a cross-sectional view of yet another switch of the present invention.

In FIG. 13, the recesses 1301 and 1302 are formed on a front side of the substrate 96. In FIG. 14, recesses 1404 and 1406 are formed on the back side of substrate 96; the recesses 1301 and 1302 in FIG. 14 are of a shallower depth than illustrated in FIG. 13. Turning back to FIG. 14, the electrodes 14100 and 1496 are positioned in the recesses 1404 and 1406 respectively. Comparing FIG. 13 and FIG. 14 the electrodes 13100 and 1394 are positioned in approximately the same location as electrodes 1404 and 1406.

Figures 15, 16, 17, 18, 19, 20, 21:
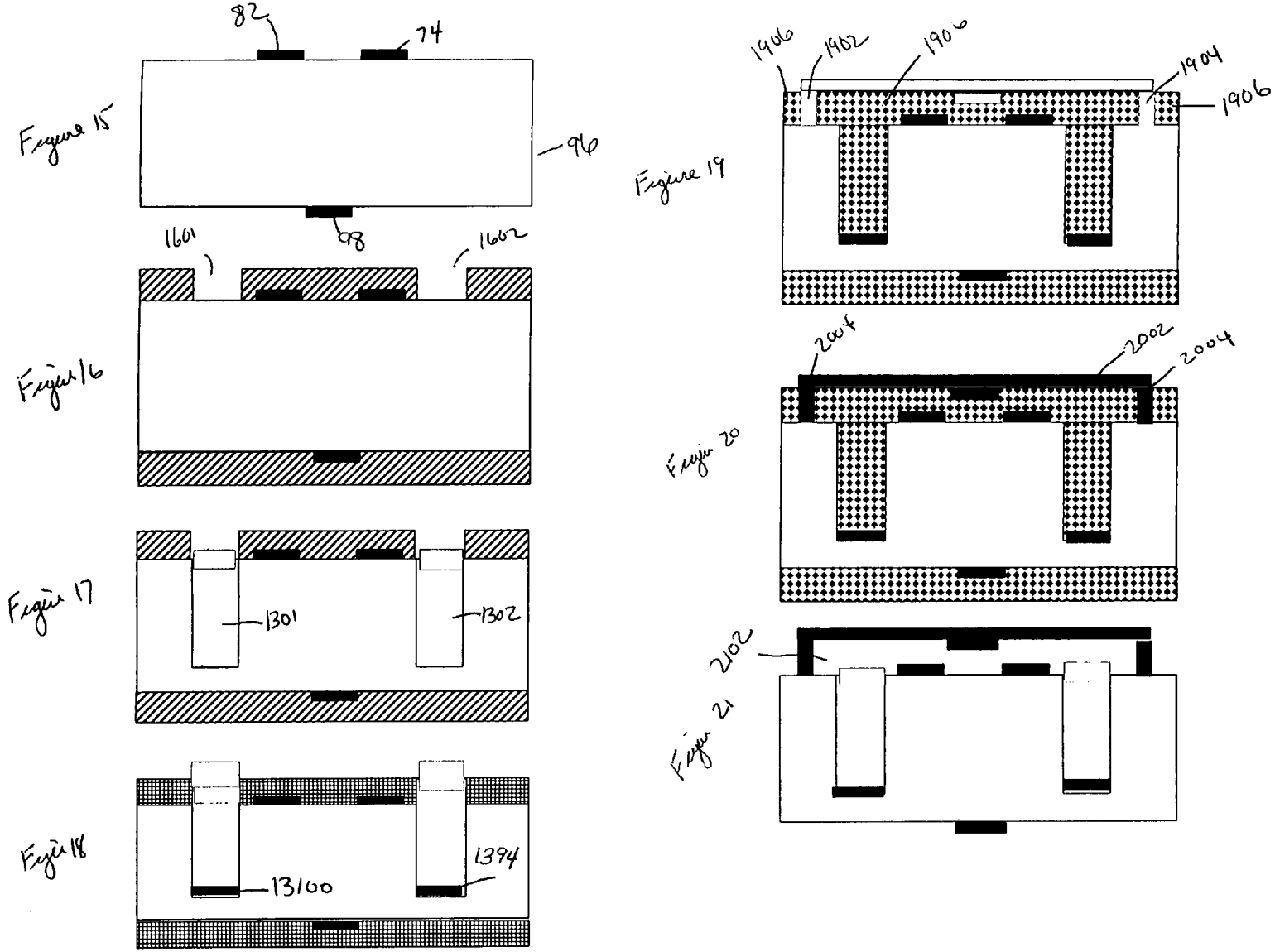
FIGS. 15-21 illustrate a process of forming the switch of the present invention.
Figure 22:
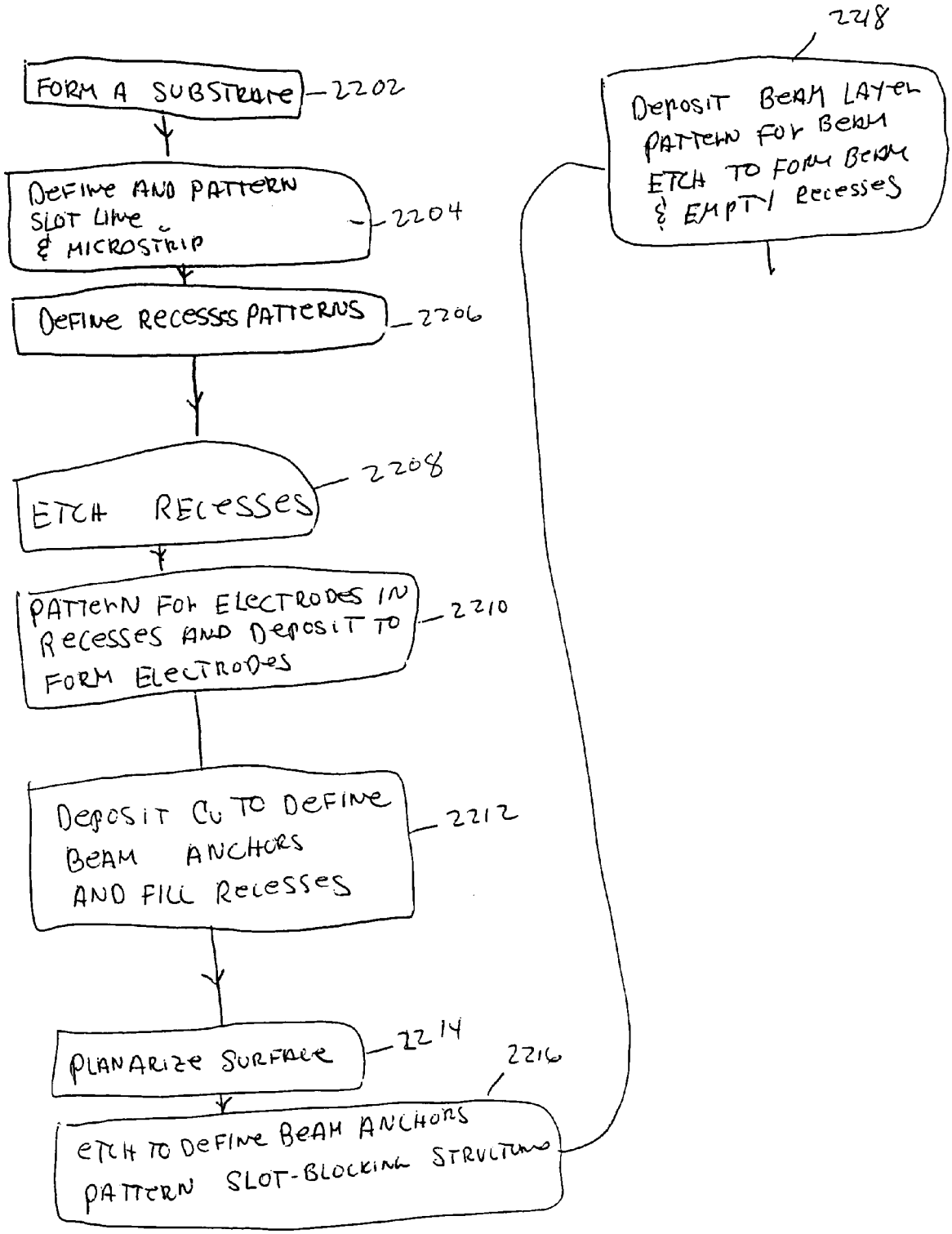
FIG. 22 shows a flow chart of the process of forming the switch of the present invention.

FIGS. 15 through FIG. 21 shows the process by which the switch can be fabricated, and FIG. 22 shows the sequence of steps of the invention. While the switch maybe fabricated and implemented by a variety of methods and materials, the described method is employed for purposes of illustration. The method in general is surface micromachining, with a substrate of low resistivity silicon, the transmission line (slot line and microstrip) metallization-chrome-gold (Cr—Au) sacrificial layer-copper, structural layer-nickel (Ni) and protection or isolation coating-silicon dioxide. In FIG. 15, the substrate is formed in step 2202 and the microstrip Cr—Au metal traces 74, 82 to define the slot 78 are defined and patterned. On the top surface of the substrate 96 the slot 78 is defined and patterned while on the bottom surface of the substrate 96 the microstrip 98 is defined and patterned by opening windows in the silicon dioxide protection layer by depositing and pattering and a adhesion layer of Cr with a approximate thickness of 200 Å and followed by a layer of Au with an approximate thickness of 2 μm in step 2204. In FIG. 16, the recess patterns 1601, 1602 are defined step 2204. More particularly a photoresist is spun on and windows are defined where the recesses/trenches 1301, 1302 are to be made in the substrate. FIG. 17 shows the process for an etching the recesses 1301, 1302 via the reactive ion etching (DRIE) in step 2208. In FIG. 18, the recess electrodes 13100, 1394 are defined in the recesses. The recess electrodes 13100, 1394 are patterned and formed by depositing a second adhesion layer of Cr with a thickness of approximately 200 Å followed by depositing a layer of gold Au with an approximate thickness of 2 μm in step 2210. Turning now to FIG. 19, a copper sacrificial layer 1906 is deposited and the beam anchor windows 1902, 1904 are defined. More particularly, the copper sacrificial layer 1906 is deposited, and the recesses are filled in step 2212. The surface is planarised by using a chemical mechanical polishing (CMP) operation in step 2214 and windows are open by etching to define beam anchor windows 1902, 1904 and to pattering slot-blocking structure. In FIG. 20, the beam 2002 and beam anchors 2004 are deposited by plating nickel Ni for approximately 2 μm. In FIG. 21, the beam 2002 is patterned and the remaining copper sacrificial layer is removed by etching to empty the recesses and form the space under the beam step 2216.

Figure 23:
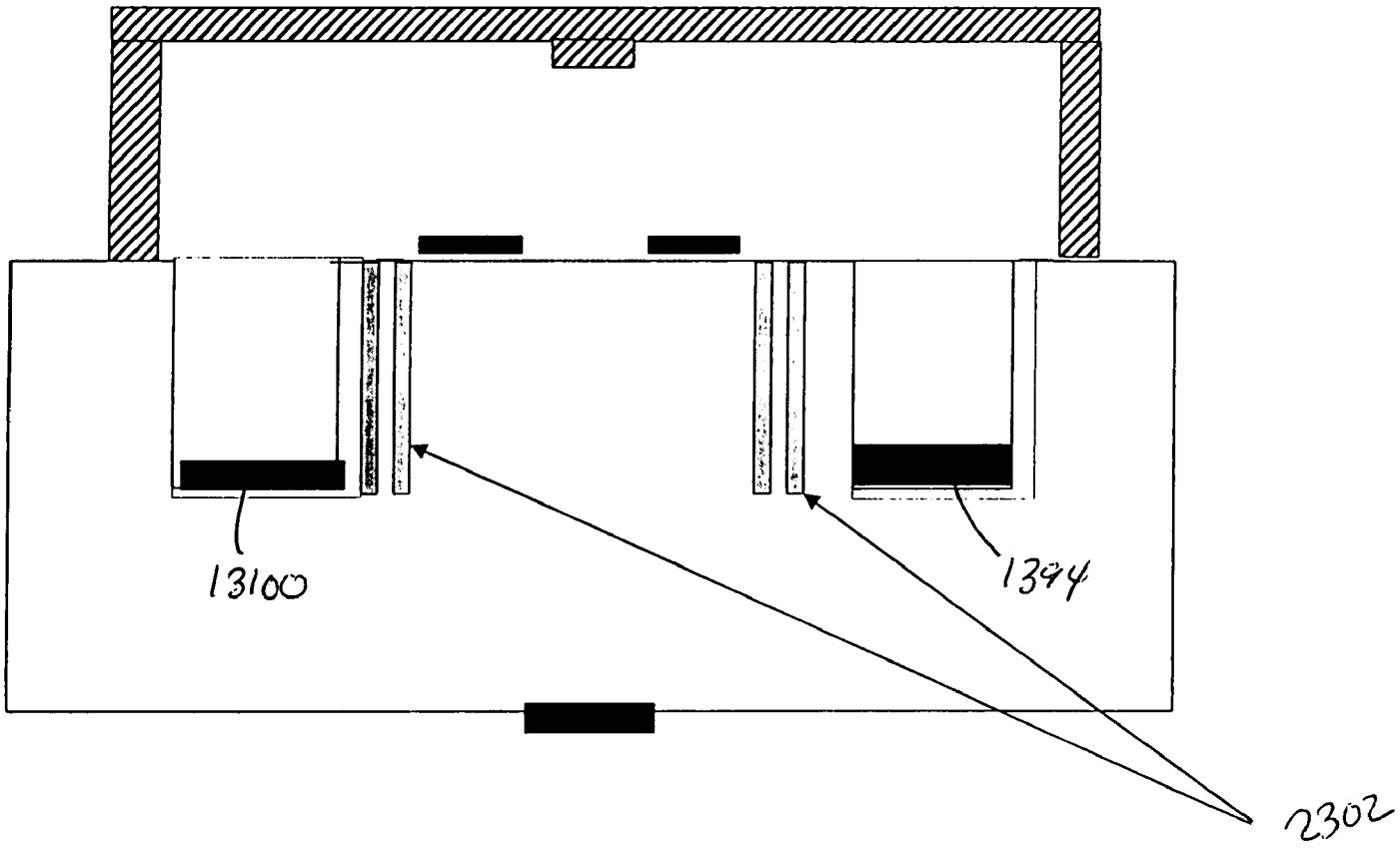
FIG. 23 illustrates a cross-sectional view of a further switch of the present invention.

FIG. 23 shows that a Photonic Bandgap Crystal (PBC) 2302 is positioned between electrodes 13100, 1394 to provide additional isolation for the electrodes 13100, 1394 and to substantially inhibit propagation of waves emanating from the slotline strips. FIG. 23 shows that a number of PBCs could be used. While four PBCs are shown in FIG. 23, additional or fewer PBCs could be used. The PBC is formed in a trench along with the formation of the recesses. As shown, the PBC 2302 is formed at approximately the same depth as the recesses 13100, 1394.

The invention disclosed is believed to be superior to prior art MEMS-based switches for the following reasons:

1) The switch operates in the pre-pull-in voltage regime, thus, no contact-related reliability issues, such as stiction or ohmic loss, resulting from snapping, are present;
2) The beam and control electrodes are naturally well isolated, so dielectric charging issues are non-existent;
3) The switch, in addition to fabrication compatible with integrated circuits, is also amenable to microwave integrated circuit (MIC), or hybrid, fabrication, thus rendering a low cost solution;
4) Because of 1), the switch lifetime is only limited by fatigue of the beam, so it has the inherent potential to achieve a lifetime of 1000 Billion cycles or greater [C. L. Muhlstein, S. B. Brown and R. O. Ritchie, "High-Cycle Fatigue of Single-Crystal Silicon Thin Films," *J. Microelectromechanical Syst.*, Vol. 10, No. 4, December 2001, pp. 593-600.]

It will be understood that various details of the invention may be changed without departing from the scope of the invention. The above concept can be applied to varactors, variable inductors, switched or reconfigurable circuits and any other known type device known to those of skill in the art requiring placement of an element on a substrate. Furthermore, the foregoing description is for the purpose of illustration only, and not for the purpose of limitation—the invention being defined by the claims.

What is claimed is:

1. A micro-electro-mechanical system (MEMS) slotline switch, comprising: a slotline transmission line structure defined on top of a substrate; a doubly-anchored conductive beam disposed perpendicular to, and above said slotline transmission line structure so that there is a predetermined space between the doubly-anchored conductive beam and the slotline transmission line structure; a beam conductive contact attached to the doubly-anchored conductive beam above a slot of the slotline transmission line structure; a recess conductive contact formed in a recess of said substrate and forming a parallel-plate capacitor with said beam conductive contact; a conductive trace defined on the bottom surface of the substrate forming a microstrip-to-slotline transition for coupling signals in microstrip line to the slotline transmission line structure; said beam and recess conductive contacts being spaced apart, and the doubly-anchored conductive beam being continuously movable when a voltage is applied between the beam and the recess conductive contacts.

2. The slotline MEMS switch of claim 1, wherein said recess is on the front side of said substrate.

3. The slotline MIEMS switch of claim 1, wherein said recess is the back side of said substrate.

4. The slotline MEMS switch of claim 1, wherein said switch further comprises an additionally recess and a crystal defined between said recess and said additional recess.

5. The slot line MEMS switch of claim 1, wherein said crystal is a PBC.

6. A method for forming a micro-electro-mechanical system (MEMS) slotline switch, comprising the steps of: forming a slotline transmission line structure defined on top of a substrate; forming a doubly-anchored conductive beam disposed perpendicular to, and above said slotline transmission line structure so that there is a predetermined space between the doubly-anchored conductive beam and the slotline transmission line structure; forming a beam conductive contact attached to the doubly-anchored conductive beam above a slot of the slotline transmission line structure; forming a recess conductive contact formed in a recess of said substrate and forming a parallel-plate capacitor with said beam conductive contact, forming a conductive trace defined on the bottom surface of the substrate forming a microstrip-to-slotlirie transition for coupling signals in microstrip line to the slotline transmission line structure; said beam and recess conductive contacts being formed spaced apart, and the doubly-anchored conductive beam being continuously movable when a voltage is applied between the beam and the recess conductive contacts.

7. The method of forming a slotline MEMS switch of claim 6, wherein said recess is formed on the front side of said substrate.

8. The method of forming a slotline MEMS switch of claim 6, wherein said recess is formed on the back side of said substrate.

9. The method of forming a slotline MEMS switch of claim 6, wherein said method further comprises the step of forming an additionally recess and a crystal defined between said recess and said additional recess.

10. The method of forming a slotline MEMS switch of claim 6, wherein said crystal is a PBC.

* * * * *